US005294589A

United States Patent [19]

Egashira

[11] Patent Number: 5,294,589

[45] Date of Patent: Mar. 15, 1994

[54] HEAT TRANSFER SHEET

[75] Inventor: Noritaka N. E. Egashira, Tokyo, Japan

[73] Assignee: Dai Nippon Insatsu Kabushiki Kaisha, Japan

[21] Appl. No.: 937,155

[22] Filed: Aug. 31, 1992

Related U.S. Application Data

[62] Division of Ser. No. 863,865, Apr. 6, 1992, Pat. No. 5,173,473, which is a division of Ser. No. 500,124, Mar. 28, 1990, Pat. No. 5,124,309.

[30] Foreign Application Priority Data

Mar. 28, 1989 [JP] Japan ..... 1-73745
Jul. 31, 1989 [JP] Japan ..... 196774
Oct. 26, 1989 [JP] Japan ..... 277106

[51] Int. Cl.[5] ..... B41M 5/035; B41M 5/38

[52] U.S. Cl. ..... 503/227; 428/195; 428/423.1; 428/447; 428/480; 428/500; 428/532; 428/913; 428/914

[58] Field of Search ..... 8/471; 428/195, 913, 428/914, 423.1, 447, 480, 500, 532; 503/227

[56] References Cited

U.S. PATENT DOCUMENTS 4,990,485 2/1991 Egashira et al. ..... 503/227

FOREIGN PATENT DOCUMENTS 0245836 11/1987 European Pat. Off. ..... 503/209
0260347 3/1988 European Pat. Off. ..... 428/488.1
0304673 3/1989 European Pat. Off. ..... 428/488.1
2202340 9/1988 United Kingdom ..... 428/488.1

OTHER PUBLICATIONS

Patent Abstracts of Japan, vol. 11, No. 76(M-569)(2523) Mar. 7, 1987 & JP-A-61 230 986 (Seiko Epson Corporation) Oct. 15, 1986.

Patent Abstracts of Japan, vol. 12, No. 471 (M-773)(3318) Dec. 9, 1988 & JP-A-63 194 983 (Tsuneo Iwasaki) Aug. 12, 1988.

*Primary Examiner*—Bruce H. Hess
*Attorney, Agent, or Firm*—Parkhurst, Wendel & Rossi

[57] ABSTRACT

A heat transfer sheet having a dye layer including a dye and binder, provided on a substrate film, said dye layer contains a compound represented by the following formula (I):

$$R=[(CH_2)_l-X-(CH_2)_m-CH_3]_2 \quad (I)$$

wherein R is a phenylene group or a napthylene group or an alkylene group which may also have substituent; X is a linking group such as —NHCOO— group, —NHCONH— group, —COO— group, —CONH group, —NHCO group, —$NHSO_2$— group, —OOC— groups, —OOCNH group, —$O.O_2S$ group-, —$SO_2NH$— group, —$SO_2.O$ group, —O— group, —NH— group, —S— group; and l and m are integers of 1 to 30.

4 Claims, No Drawings

HEAT TRANSFER SHEET

This is a divisional application of application Ser. No. 07/863,865, filed Apr. 6, 1992, now U.S. Pat. No. 5,173,473, which in turn is a divisional application of application Ser. No. 07/500,124, filed Mar. 28, 1990, now U.S. Pat. No. 5,124,309.

BACKGROUND OF THE INVENTION

This invention relates to a heat transfer sheet, more particularly to a heat transfer sheet which is useful for a heat transfer system by use of a sublimable dye (heat migratable dye), excellent in dye migratability during heat transfer, and also can give excellent image density.

As the method for giving excellent monocolor or fullcolor image simply and at high speed in place of the impact printing or general printing method, non-impact printing such as an ink jet system or the heat transfer system has been developed. Among these, the so called sublimation heat transfer system by use of a sublimable dye is the most excellent as one having excellent continuous gradation and giving fullcolor image comparable with color photography.

The heat transfer sheet to be used in the sublimation type heat transfer system as mentioned above may be generally one having a dye layer comprising a sublimable dye and a binder formed on one surface of a substrate film such as polyester film, and a heat-resistant layer provided on the other surface of the substrate film for prevention of sticking of a thermal head.

By superposing the dye layer surface of such a heat transfer sheet on an image receiving material having an image receiving layer comprising a polyester resin and the like, and heating imagewise from the back of the heat transfer sheet by a thermal head, the dye in the dye layer is transferred to the image receiving material to form a desired image.

In the heat transfer system as described above, only the dye is migrated from the dye layer to the image receiving material, and the binder remains on the substrate film side. In this case, sharper and higher density images can be formed, as the migratability of the dye is better.

As the method for improving migratability of the dye, it is the simplest to increase printing energy, but higher printing energy undesirably results in increased printing cost. Further, when a plastic film is used as the substrate film, the thermal energy which can be applied is of itself limited.

As another method, it has been well known in the art to use a dye of low molecular weight, but when the molecular weight of the dye is low, there ensues the problem that fastness of the image formed, such as bleed resistance, and heat resistance, is inferior.

As the method for circumventing such problems, the method of using a dye with a high molecular weight has been known. However, use of these dyes with high molecular weights involves the problem that migratability of the dye becomes inferior, thus preventing the formation of a sharp and high density image.

Accordingly, a first object of the present invention is to provide a heat transfer sheet which can form an image of satisfactory density with lower printing energy as compared with the prior art, or can form an image of higher density with the same printing energy as in the prior art.

Meanwhile, another known method for improving migratability of the dye is to add a compound having a low melting point such as wax, etc. as the sensitizer into the dye layer. However, addition of these low melting compounds gives rise to problems such as blocking of the heat transfer sheet wound up in a roll, bleeding of the dye to be transferred to the back, etc. Further, during heat transfer, there ensues the problem that the dye layer tends to be fused onto the surface of an image receiving material to be peeled off with difficulty. When it is peeled off, the dye layer tends to be migrated to the image receiving material.

An addition of fine particles such as silica as the release agent into the dye layer may be conceivable for solving these problems. However, in this case, the transferred image becomes coarse, thereby causing the problem that color reproducibility and resolution become low. Also, there is the method of adding a silicone oil as the release agent, but such silicone oil has no compatibility with the dye layer, whereby problems such as generation of surface stickness, occurrence of discoloration of the transferred image, reduced storability and the like, result.

Therefore, a second object of the present invention is to provide a heat transfer sheet which can form an image of satisfactory density with lower printing energy as compared with the prior art, or can form an image of higher density with the same printing energy as in the prior art without causing problems of storability and fusion to occur.

SUMMARY OF THE INVENTION

A first object of the present invention is accomplished as mentioned below.

That is, the first embodiment of the present invention is a heat transfer sheet having a dye layer comprising a dye and a binder provided on a substrate film, characterized in that said dye layer contains a compound represented by the following formula (I):

$$R=[CH_2)_l—X—(CH_2)_m—CH_3]_2 \quad (I)$$

wherein R is a phenylene group or a naphthylene group or an alkylene group which may also have substituent, X is a linking group such as —NHCOO— group, —NHCONH— group, —COO— group, —CONH group —NHCO group, —$NHSO_2$— group, —OOC— group, —OOCNH group, —$O.O_2S$— group, —$SO_2NH$— group, —$SO_2$.O group, —O— group, —NH— group, —S— group, etc., l and m are integers of 1 to 30.

By permitting the compound represented by the above formula (I) to exist in the dye layer, an image of satisfactory density can be formed with lower printing energy as compared with the prior art, and also, a heat transfer sheet capable of forming an image with higher density can be provided with the same printing energy as in the prior art.

A second object of the present invention is accomplished by the second and third inventions as mentioned below.

That is, the second embodiment is a heat transfer sheet having a dye layer comprising a dye, binder, sensitizer and a release agent provided on a substrate film, characterized in that the sensitizer is a low molecular weight substance having a melting point of 50° to 150° C., and the release agent is a graft copolymer having at least one releasable segment selected from polysiloxane segments, fluorinated carbon segments and long chain alkyl segments graft-bonded to the main chain of the copolymer.

By permitting a sensitizer and a specific polymer release agent to exist in the dye layer, an image of satisfactory density can be formed with lower energy than the prior art without occurrence of problems of storability and fusion, and also, a heat transfer sheet capable of forming an image of further higher density and precision can be provided with the same printing energy as in the prior art.

The third embodiment of the present invention is a heat transfer sheet having a dye layer comprising a dye, binder and sensitizer provided on a substrate film, characterized in that the sensitizer and binder have functional groups which react to be bonded to each other.

By forming a dye layer by use of a sensitizer and a binder which can react to be bonded to each other, an image of satisfactory density can be formed with lower energy than the prior art without occurrence of problems of storability and fusion, and also, a heat transfer sheet capable of forming an image of further higher density and precision can be provided with the same printing energy as in the prior art.

DETAILED DESCRIPTION OF THE INVENTION

Referring now to preferred embodiments, the present invention is described in more detail.

First embodiment

The heat transfer sheet according to the first embodiment of the present invention comprises basically a dye layer formed on a substrate film similarly as in the prior art, but it is characterized by including a compound represented by the above formula (I) in the dye layer.

As the substrate film of the heat transfer sheet of the present invention as described above, any of those known in the art having heat resistance and strength to some extent may be available, as exemplified by papers, various converted papers, polyester films, polystyrene films, polypropylene films, polysulfone films, aramide films, polycarbonate films, polyvinyl alcohol films, cellophane, etc. having a thickness of about 0.5 to 50 μm, preferably 3 to 10 μm, particularly preferably polyester films. These substrate films may be either in separated sheet form or continuous film, and not particularly limited.

The dye layer to be formed on the surface of the above-mentioned substrate film is a layer having at least a dye and a compound of the above formula (I) carried with any desired binder resin.

As the dye to be used, all of the dyes used in the heat transfer sheet known in the art are available and not particularly limited. For example, some preferable dyes may include, as red dyes, MS Red G, Macrolex Red Violet R, Ceres Red 7B, Samaron Red HBSL, Resolin Red F3BS, etc., and also as yellow dyes, Foron Brilliant Yellow S-6GL, PTY-52, Macrolex Yellow 6G, etc., and also as blue dyes, Kayaset Blue 714, Waxoline Blue AP-FW, Foron Brilliant Blue S-R, MS Blue 100, etc.

As the binder resin for carrying the dye as mentioned above, any one of those known in the prior art can be used, and preferable examples may include cellulose resins such as ethyl cellulose, hydroxyethyl cellulose, ethylhydroxy cellulose, hydroxypropyl cellulose, methyl cellulose, cellulose diacetate, cellulose triacetate, cellulose acetate butyrate, etc.; vinyl resins such as polyvinyl alcohol, polyvinyl acetate, polyvinyl butyral, polyvinyl acetal, polyvinyl pyrrolidone, polyacrylamide, etc.; polyesters; and so on. Among them, cellulose type, acetal type, butyral type and polyester type, etc. are preferable from the points of heat resistance, migratability of dye, etc.

The compound represented by the formula (I) to be used in the present invention is obtained by the reaction of a compound having two functional groups such as aminoalkyl group, hydroxyalkyl group, halogenoalkyl group, carboxyalkyl group, sulfonylalkyl group, isocyanatealkyl group, etc. on a benzene ring or naphthalene ring which may also have substituents with an aliphatic compound having functional groups reactive with these functional groups. Also, by replacing the above bifunctional aromatic compound with bifunctional aliphatic compound such as ethylenediamine, propylenediamine, tetramethylenediamine, ethylene glycol, triethylene glycol, tetramethylene glycol, ethylene diisocyanate, propylene diisocyanate, isophorone diisocyanate, tetramethylene diisocyanate, malonic acid, succinic acid, glutaric acid, adipic acid, etc., the compound represented by the above formula (I) exhibiting the same effect can be obtained.

In the above formula (I), l should be preferably an integer within the range of 1 to 30, m an integer within the range of 1 to 30, and l+m an integer within the range of 1 to 60. By making l+m within the range specified above, the melting point represented by the formula (I) may be such that it can be easily and sharply melted by the heat from a thermal head, for example, at a temperature of 60° C. to 150° C., whereby excellent migratability of the dye can be accomplished.

Specific examples of preferable compounds may include the following compounds:

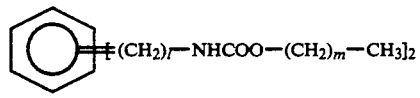

(1)

(l = 1-3, m = 1-5)

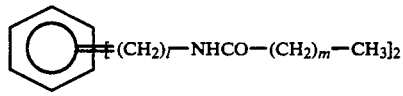

(2)

(l = 1-3, m = 1-5)

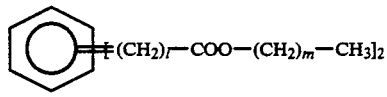

(3)

(l = 1-3, m = 1-5)

$(CH_2)_n=[(CH_2)_l—NHCOO—(CH_2)_m—CH_3]_2$ (4)
(l = 1-3, m = 1-5, n = 1-7)

$(CH_2)_n=[(CH_2)_l—NHCO—(CH_2)_m—CH_3]_2$ (5)
(l = 1-3, m = 1-5, n = 1-7)

$(CH_2)_n=[(CH_2)_l—COO—(CH_2)_m—CH_3]_2$ (6)
(l = 1-3, m = 1-5, n = 1-7)

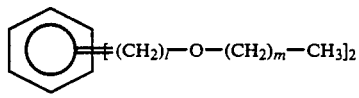

(7)

(l = 1-3, m = 1-5)

$(CH_2)_n=[(CH_2)_l—O—(CH_2)_m—CH_3]_2$ (8)
(l = 1-3, m = 1-5, n = 1-7)

-continued

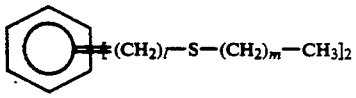

(9)

(l = 1-3, m = 1-5)

$$(CH_2)_n{=}[(CH_2)_l{-}S{-}(CH_2)_m{-}CH_3]_2 \quad (10)$$

(l = 1-3, m = 1-5, n = 1-7)

The content of the above compound should be preferably 5 to 50 parts by weight per 100 parts by weight of the binder in the dye layer. If it is less than 5 parts by weight, the improvement effect of migratability of dye is insufficient, while if it is over 50 parts by weight, heat resistance of the dye layer is undesirably lowered.

Further, other various additives known in the art can be also included in the dye layer.

Such dye layer may be formed preferably by dissolving or dispersing the sublimable dye, the binder resin, the release agent and other optional components as mentioned above in an appropriate solvent to prepare a coating material or ink for formation of dye layer, and coating and drying this on a substrate.

The dye layer thus formed has a thickness of about 0.2 to 5.0 μm, preferably 0.4 to 2.0 μm, and the sublimable dye in the dye layer should preferably exist in an amount of 5 to 90% by weight, preferably 10 to 70%, by weight of the dye layer.

The dye layer to be formed, when the desired image is mono-color, is formed by selecting one color from among the above-mentioned dyes, while when the desired image is a full-color image, for example, appropriate cyan, magenta and yellow (further black, if necessary) are selected to form a dye layer of yellow, magenta and cyan (and further black, if necessary).

The image receiving material to be used for formation of image by use of the heat transfer sheet as described above, any one may be available, provided that its recording surface has dye receptivity for the above-mentioned dye, and also in the case of paper, metal, glass, synthetic resin, etc. having no dye receptivity, a dye receiving layer may be formed on at least one surface thereof.

Examples of the image receiving material which need not form a dye receiving layer may include fibers, woven fabrics, films, sheets, molded products, etc. comprising polyolefin resins such as polypropylene, etc.; halogenated polymers such as polyvinyl chloride, polyvinylidene chloride, etc.; vinyl polymers such as polyvinyl acetate, polyacrylate, etc.; polyester resins such as polyethylene terephthalate, polybutylene terephthalate, polyethylene naphthalate, etc.; polystyrene resins; polyamide resins; copolymer resins of an olefin such as ethylene, propylene, etc. with other vinyl monomers; ionomers; cellulose resins such as cellulose diacetate, etc.; polycarbonate; and so on. Particularly preferred are sheets or films comprising polyesters or converted papers having polyester layer provided thereon.

Also, in the present invention, even a non-dyeable image receiving material such as paper, metal, glass and others can be also used as the image receiving material by coating and drying a solution or dispersion of a dyeable resin as described above or laminating such resin film on its recording surface. Further, even the image receiving material having dyeability may have also a dye receiving layer as in the case of the above-mentioned paper formed on its surface from a resin with still better dyeability.

The dye receiving layer thus formed may be formed from a single material or a plurality of materials, and further various additives may be included within the range which does not interfere with the object of the present invention as a matter of course.

The thickness of such dye receiving layer may be any desired one, but may be generally a thickness of 3 to 50 μm. Also, such dye receiving layer may be preferably a continuous coating, but it may be also formed as incontinuous coating by use of a resin emulsion or a resin dispersion.

The means for imparting energy to be used during performing heat transfer by use of the heat transfer sheet and the image receiving material as described above may be any imparting means known in the art. For example, by means of a recording device such as a thermal printer (e.g. Video Printer VY-100, Hitachi K.K., Japan), etc., by imparting a heat energy of about 5 to 100 mJ/mm$^2$ by controlling the recording time, a desired image can be formed.

According to the present invention as described above, by permitting the compound represented by the above formula (I) in the dye layer, a heat transfer sheet can be provided, which can form an image of satisfactory density with lower printing energy as compared with the prior art, and also can form an image of further higher density with the same energy as in the prior art.

Such effects may be considered to be due to the fact that, since the compound represented by the formula (I) has the property of melting very easily and sharply by the heat from a thermal head, heat migration to the dye during heat transfer becomes easier, and also migratability of the dye is remarkably improved.

Second embodiment

The heat transfer sheet of the second embodiment of the present invention comprises basically a dye layer formed on a substrate film similarly as in the prior art, but it is characterized by including a sensitizer and a specific release agent in said dye layer.

As the substrate film of the heat transfer sheet of the present invention as described above, any of those known in the art having heat resistance and strength to some extent may be available, as exemplified by papers, various converted papers, polyester films, polystyrene films, polypropylene films, polysulfone films, aramide films, polycarbonate films, polyvinyl alcohol films, Cellophane, etc. having a thickness of about 0.5 to 50 μm, particularly preferably polyester films. These substrate films may be either in separated sheet form or continuous film, and not particularly limited. Among these, particularly preferable is a polyethylene terephthalate film with the surface previously subjected to easily adherable treatment.

The dye layer to be formed on the surface of the above-mentioned substrate film is a layer having at least a dye, a sensitizer and a release agent carried with any desired binder resin.

As the dye to be used, all of the dyes used in the heat transfer sheet known in the art are effectively available and not particularly limited. For example, some preferable dyes may include, as red dyes, MS Red G, Macrolex Red Violet R, Ceres Red 7B, Samaron Red HBSL, Resolin Red F3BS, etc., and also as yellow dyes, Foron Brilliant Yellow S-6GL, PTY-2, Macrolex Yellow 6G, etc., and also as blue dyes, Kayaset Blue 714, Waxoline Blue AP-FW, Foron Brilliant Blue S-R, MS Blue 100, etc.

As the binder resin for carrying the dye as mentioned above, any one of those known in the prior art can be used, and preferable examples may include cellulose resins such as ethyl cellulose, hydroxyethyl cellulose, ethylhydroxy cellulose, hydroxypropyl cellulose, methyl cellulose, cellulose diacetate, cellulose triacetate, cellulose acetate butyrate, etc.; vinyl resins such as polyvinyl alcohol, polyvinyl acetate, polyvinyl butyral, polyvinyl acetal, polyvinyl pyrrolidone, polyacrylamide, etc.; polyesters; and so on. Among them, cellulose type, acetal type, butyral type and polyester type, etc. are preferable from the points of heat resistance, migratability of dye, etc. Also, these binders should preferably have a Tg of 50° C. or higher, because if Tg is lower than 50° C., the binder is liable to be softened when the sensitizer is melted during heat transfer, whereby the dye layer becomes readily fused to the image receiving material undesirably.

The sensitizer to be used in the present invention is a low molecular weight substance having a melting point of 50° to 150° C. If the melting point is lower than 50° C., the sensitizer will be readily migrated to the dye surface to generate such problem as blocking, etc., while if the melting point exceeds 150° C., the sensitizing action will be abruptly lowered undesirably.

The sensitizer to be used in the present invention should preferably have a molecular weight within the range of 100 to 1,500. If the molecular weight is less than 100, it is difficult to maintain the melting point at 50° C. or higher, while if the molecular weight exceeds 1,500, sharpness of melting of the sensitizer during heat transfer is lost, whereby the sensitizing action becomes insufficient undesirably.

The above sensitizer should be used at a ratio of 1 to 100 parts by weight per 100 parts by weight of the binder forming the dye layer. If the amount used is less than 1 part by weight, it is difficult to obtain satisfactory sensitizing action, while if it exceeds 100 parts by weight, heat resistance of the dye layer will be lowered undesirably.

The sensitizer as described above may be any known low molecular substance, provided that it has a melting point of 50° to 150° C., but preferable sensitizers in the present invention may include thermoplastic resin oligomers, for example, various oligomers such as polyurethane oligomer, polystyrene oligomer, polyester oligomer, polyacryl oligomer, polyethylene oligomer, polyvinyl chloride oligomer, polyvinyl acetate oligomer, ethylene/vinyl acetate copolymer oligomer, ethylene-acryl copolymer oligomer, polyoxyethylene oligomer, polyoxypropylene oligomer, polyoxyethylenepropylene oligomer, etc.; fatty acids such as myristic acid, palmitic acid, malgaric acid, stearic acid, arachic acid, montanic acid, etc.; fatty acid amides such as caproic acid amide, caprylic acid amide, lauric acid amide, stearic acid amide, oleic acid amide, eicosenic acid amide, etc.; fatty acid esters such as methyl behenate, methyl lignocerate, methyl montanate, pentadecyl palmitate, hexacosyl stearate, carbamic acid [1,4-phenylenebis(methylene)]bisdimethyl ester, etc.; otherwise, aromatic compounds such as 1,4-dicyclohexylbenzene, benzoic acid, aminobenzophenone, dimethyl terephthalate, fluoranthene, phenols, naphthalenes, phenoxys; various waxes; and so on.

The release agent to be used in the present invention is a polymer having at least one releasable segment, having releasable segments graft-bonded as the side chain to a polymer which is the main chain.

The releasable segment of such polymer itself is generally low in compatibility with the polymer as the main chain. Therefore, when the dye layer is formed by adding such polymer into the dye layer, or by use of the releasable polymer as the binder, the releasable segments are susceptible to microphase separation from the dye layer thereby to bleed out on the surface of the dye layer. On the other hand, the main chain tends to be integrated with the dye layer to adhere onto the substrate film. By concerting of these actions, the releasable segments are enriched on the surface side of the dye layer, whereby good releasability can be obtained. The releasable segments will not be departed from the dye layer with the main chain, and therefore they never migrated onto the surface of other articles such as image receiving material.

The above-mentioned releasable polymer is a graft copolymer having at least one releasable segment selected from polysiloxane segments, fluorinated carbon segments and long-chain alkyl segments graft-bonded to the main chain.

As the polymer of the main chain, any polymer having reactive functional group known in the art may be used. Preferable examples may include cellulose resins such as ethyl cellulose, hydroxyethyl cellulose, ethylhydroxy cellulose, hydroxypropyl cellulose, methyl cellulose, cellulose acetate, cellulose acetate butyrate, etc.; vinyl resins such as acrylic resin, polyvinyl alcohol, polyvinyl acetate, polyvinyl butyral, polyvinyl acetal, polyvinyl pyrrolidone, polyacrylamide, etc.; polyamide resins; polyurethane resins; polyester resins; and so on. Among these, from the point of compatibility with the binder, acrylic, vinyl, polyester, polyurethane, polyamide or cellulose resins are particularly preferred.

The above-mentioned releasable copolymer can be synthesized according to various methods. As a preferable method, the method of reacting a releasable compound having a functional group reactive with the functional group existing in the main chain after formation of said main chain may be employed.

As an example of the releasable compound having the above-mentioned functional group, the compounds as set forth below maybe included.

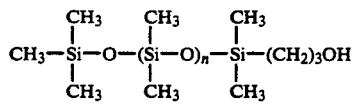
(1)

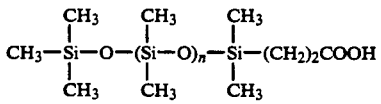
(2)

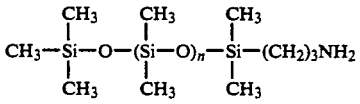
(3)

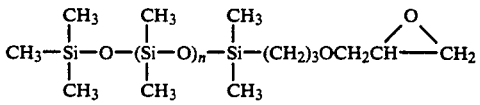
(4)

-continued

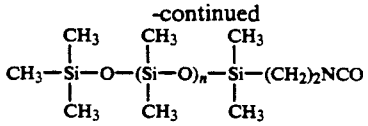

(5)

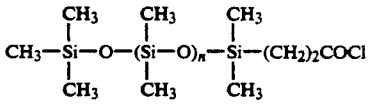

(6)

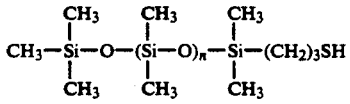

(7)

In the above formulae, a part of methyl groups may be also substituted with other alkyl groups or aromatic groups such as phenyl group, etc.

$C_8F_{17}C_2H_4OH$ (8)

$C_6F_{13}C_2H_4OH$ (9)

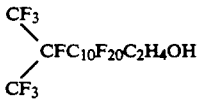

(10)

alcohol, capryl alcohol, lauryl alcohol, myristyl alcohol, cetyl alcohol, stearyl alcohol, oleyl alcohol, linoleyl alcohol, ricinoleyl alcohol, etc.; higher aldehydes such as capric aldehyde, lauric aldehyde, myristic aldehyde, stearic aldehyde, etc.; higher amines such as decylamine, laurylamine, cetylamine, etc.

The above examples are merely illustrative, and other various reactive releasable compounds are available from, for example, Shinetsu Kagaku K.K., Japan, etc. and all of them can be used in the present invention. Particularly preferable is a mono-functional releasable compound having one functional group in one molecule, and when a polyfunctional compound having two or more functionalities is used, the graft copolymer obtained tends to be gelled undesirably.

The relationship of the above-mentioned functional releasable compound and the main chain polymer as illustrated above may be as shown below in Table 1, when the functional group of the releasable compound is represented by X and the functional group of the main chain polymer by Y. Of course, the relationship between X and Y may be vice versa, or the respective groups may be used in mixtures, and also these examples are not limitative, so long as both are reactive with each other.

TABLE B1

| X | Y |
|---|---|
| —NCO | —OH, —$NH_2$, —NHR—, —COOH, —SH, etc. |
| —COCl | —OH, —$NH_2$, —NHR—, —SH, etc. |
| 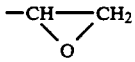 | —OH, —$NH_2$, —COOH, etc. |
| 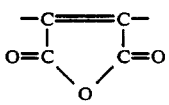 | —OH, —$NH_2$, —NHR, —SH, etc. |
| —OH, —SH | 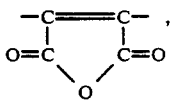 , —NCO, —COOR, —CHO, —COCl, —COOH, etc. |
| —$NH_2$, —NHR— | 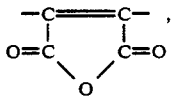 , —NCO, —COOH, —COCl, 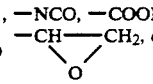 , etc. |
| —COOH | 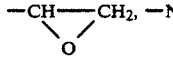 , —NCO, —OH, —$NH_2$, —NHR—, etc. |

$C_8F_{17}C_2H_4OH$ (11)

$C_{10}F_{21}C_2H_4OH$ (12)

$C_8F_{17}SO_2N(C_2H_5)C_2H_4OH$ (13)

$C_8F_{17}SO_2N(C_2H_5)C_2H_4OH$ (14)

$C_6F_{13}COOH$ (15)

$C_6F_{13}COCl$ (16)

$C_8F_{17}C_2H_4SH$ (17)

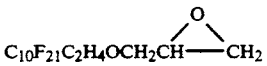

(18)

(c) Long-chain alkyl compounds

Higher fatty acids such as lauric acid, myristic acid, palmitic acid, stearic acid, oleic acid, linoleic acid, etc. and acid halides thereof; higher alcohols such as nonyl As another preferable preparation method, also by reacting the above-mentioned functional releasable compound with a vinyl compound having a functional group reactive with the functional group to form a monomer having a releasable segment, and copolymerizing this with various vinyl monomers, a desired graft copolymer can be similarly obtained.

As another preferable preparation method, there may be employed the method in which a mercapto compound such as the above exemplary compound (7) or a releasable vinyl compound as mentioned above is added to a polymer having unsaturated double bond in its main chain such as unsaturated polyester, copolymer of vinyl monomer with a diene compound such as butadiene, etc. to be grafted thereon.

The above methods are preferable examples of preparation methods, and the present invention can also use graft copolymers prepared by other methods as a matter of course.

The content of the releasable segments in the above-mentioned polymer may be preferably within the range of the amount of the releasable segments occupied in the polymer ranging from 3 to 60% by weight. If the amount of the releasable segments is too small, releasability becomes insufficient, while if it is too much, compatibility with the binder or the coating strength of the dye layer is lowered, and also the problem of discoloration or storability of the transferred image will occur undesirably.

The releasable polymer as described above can be also used as the binder in place of the above-described binder.

The heat transfer sheet of the present invention can be obtained by coating and drying a solution of the dye, the sensitizer, the release agent and the binder as described above with addition of necessary additives dissolved in an appropriate organic solvent or at dispersion thereof in an organic solvent or water on at least one surface of the above-mentioned substrate film by formation means such as the gravure printing method, the screen printing method, the reverse roll coating method by use of gravure plate, etc. thereby forming a dye layer.

The dye layer thus formed has a thickness of about 0.2 to 5.0 μm, preferably 0.4 to 2.0 μm, and the sublimable dye in the dye layer should exist suitably in an amount of 5 to 90% by weight, preferably 10 to 70% by weight of the weight of the dye layer.

The dye layer to be formed, when the desired image is mono-color, is formed by selecting one color from among the above-mentioned dyes, while when the desired image is a full-color image, for example, appropriate cyan, magenta and yellow (further black, if necessary) are selected to form a dye layer of yellow, magenta and cyan (and further black, if necessary).

According to the present invention as described above, by adding a sensitizer and a specific release agent into the dye layer, a heat transfer sheet which can form an image of satisfactory density with lower printing energy as compared with the prior art or can form an image of further higher density with the same energy as in the prior art without causing the problems of storability and fusion to occur can be obtained.

Third embodiment

The third embodiment of the heat transfer sheet of the present invention comprises basically a dye layer formed on a substrate film similarly as in the prior art, but it is characterized by forming said dye layer from a sensitizer and a binder which can react to be bonded to each other.

As the substrate film of the heat transfer sheet of the present invention as described above, any of those known in the art having heat resistance and strength to some extent may be available, as exemplified by papers, various converted papers, polyester films, polystyrene films, polypropylene films, polysulfone films, aramide films, polycarbonate films, polyvinyl alcohol films, Cellophane, etc. having a thickness of about 0. to 50 μm, preferably 3 to 10 μm, particularly preferably polyester films. These substrate films may be either in separated sheet form or continuous film, and not particularly limited. Among these, particularly preferable is a polyethylene terephthalate film with the surface previously subjected to easily adherable treatment.

As the dye to be used for the dye layer, all of the dyes used in the heat transfer sheet known in the art are effectively available and not particularly limited. For example, some preferable dyes may include, as red dyes, MS Red G, Macrolex Red Violet R, Ceres Red 7B, Samaron Red HBSL, Resolin Red F3BS, etc., and also as yellow dyes, Foron Brilliant Yellow S-6GL, PTY-52, Macrolex Yellow 6G, etc., and also as blue dyes, Kayaset Blue 714, Waxoline Blue AP-FW, Foron Brilliant Blue S-R, MS Blue 100, etc.

As the binder resin for carrying the dye as mentioned above, any one of those known in the prior art having reactive groups as shown below in Table C1 can be used, and preferable examples may include cellulose resins such as ethyl cellulose, hydroxyethyl cellulose, ethylhydroxy cellulose, hydroxypropyl cellulose, methyl cellulose, cellulose diacetate, cellulose triacetate, cellulose acetate butyrate, etc.; vinyl resins such as polyvinyl alcohol, polyvinyl acetate, polyvinyl butyral, polyvinyl acetal, polyvinyl pyrrolidone, etc.; acrylic resins such as poly(meth)acrylte, poly(meth)acrylamide; polyurethane resins, polyamide resin, polyesters; and so on. Among them, cellulose type, vinyl type, acrylic, olyurethane type and polyester type, etc. are preferable from the points of heat resistance, migratability of dye, etc.

Further, by use of releasable resins of various resins as mentioned above subjected to silicone modification, fluorine modification or long-chain alkyl modification as the binder, use of a release agent which generates various problems can be precluded or reduced.

Also, these binders should preferably have a Tg (glass transition point) of 50° C. or higher, because if Tg is lower than 50° C., the binder is liable to be softened when the sensitizer is melted during heat transfer, whereby the dye layer becomes readily fused to the image receiving material undesirably.

The sensitizer to be used in the present invention is a low molecular weight substance having a functional group which can react with and bond to the functional group of the above-mentioned binder is shown below in Table C1 and having a relatively lower melting point, for example, 50° to 150° C. The melting point may be lower than 50° C. However, in this case, before the reaction of the sensitizer and the binder, handleability is not good with respect to sticking and blocking. On the other hand, if the melting point exceeds 150° C., the sensitizing action will be abruptly lowered undesirably.

The sensitizer to be used in the present invention should preferably have a molecular weight within the range of 100 to 1,500. If the molecular weight is less than 100, it is difficult to maintain the melting point at 50° C. or higher, while if the molecular weight exceeds 1,500, sharpness of melting of the sensitizer during heat transfer is lost, whereby the sensitizing action becomes insufficient undesirably.

The above sensitizer should be used at a ratio of 1 to 100 parts by weight per 100 parts by weight of the binder forming the dye layer. If the amount used is less than 1 part by weight, it is difficult to obtain satisfactory sensitizing action, while if it exceeds 100 parts by weight, heat resistance of the dye layer will be lowered undesirably.

The sensitizer as described above may be any known low molecular substance, but preferable sensitizers in the present invention may include thermoplastic resin oligomers, for example, various oligomers such as polyurethane oligomer, polystyrene oligomer, polyester oligomer, polyacryl oligomer, polyethylene oligomer, polyvinyl chloride oligomer, polyvinyl acetate oligomer, ethylene/vinyl acetate copolymer oligomer, ethylene-acryl copolymer oligomer, polyoxyethylene oligomer, polyoxypropylene oligomer, polyoxyethylenepropylene oligomer, etc.; fatty acids such as myristic acid, palmitic acid, malgaric acid, stearic acid, arachic acid, montanic acid, etc.; fatty acid amides such as caproic acid amide, caprylic acid amide, lauric acid amide, stearic acid amide, oleic acid amide, eicosenic acid amide, etc; fatty acid esters such as methyl behenate, methyl lignocerate, methyl montanate, pentadecyl palmitate, hexacosyl stearate, carbamic acid [1,4-phenylenebis(methylene)]bisdimethyl ester, etc.; otherwise, aromatic compounds such as 1,4-dicyclohexylbenzene, benzoic acid, aminobenzophenone, dimethyl terephthalate, fluoranthene, phenols, naphthalenes, phenoxys; various waxes; and so on.

The relationship of the above-mentioned sensitizer and the respective functional groups capable of reaction and bonding therewith of the above-mentioned binder may be as shown below in Table C1, when the functional group of the sensitizer is represented by X and the functional group of the binder by Y. Of course, the relationship between X and Y may be vice versa, or the respective groups may be used in mixtures, and also these examples are not limitative, so long as both are reactive with each other.

TABLE C1

| X | Y |
|---|---|
| —NCO | —OH, —$NH_2$, —NHR—, —COOH, —SH, etc. |
| —COCl | —OH, —$NH_2$, —NHR—, —SH, etc. |
| 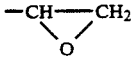 | —OH, —$NH_2$, —COOH, etc. |
| 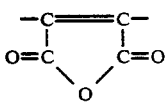 | —OH, —$NH_2$, —NHR, —SH, etc. |
| —OH, —SH | 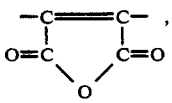 , —NCO, COOR, —CHO, —COCl, —COOH, etc. |
| —$NH_2$, —NHR— | 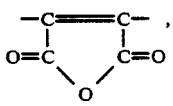 , —NCO, COOH, —COCl, —CH—$CH_2$, etc. O |
| —COOH |  —NCO, —OH, —$NH_2$, —NHR— |
| —CH=CH— —CH=$CH_2$ | —CH=CH— —CH=$CH_2$ |

The reaction between the binder and the sensitizer as described above may be either before formation of the dye layer or during formation of the dye layer, further after formation of the dye layer, provided that it is before practicing heat transfer.

The mode of the reaction of the both may differ depending on the combination of the respective functional groups, and is not particularly limited, but may include, for example, normal temperature reaction, heating reaction, catalyst reaction, photoreaction, radiation reaction, reaction with polymerization initiator, etc.

The heat transfer sheet of the present invention can be obtained by coating and drying a solution of the dye, the sensitizer, the release agent and the binder as described above with addition of necessary additives dissolved in an appropriate organic solvent or a dispersion thereof in an organic solvent or water on at least one surface of the above-mentioned substrate film by formation means such as the gravure printing method, the screen printing method, the reverse roll coating method by use of gravure plate, etc. thereby forming a dye layer.

The dye layer thus formed has a thickness of about 0.2 to 5.0 μm, preferably 0.4 to 2.0 μm, and the sublimable dye in the dye layer should exist suitably in an amount of 5 to 90% by weight, preferably 10 to 70% by weight, of the weight of the dye layer.

The dye layer to be formed, when the desired image is mono-color, is formed by selecting one color from among the above-mentioned dyes, while when the desired image is a full-color image, for example, appropriate cyan, magenta and yellow (further black, if necessary) are selected to form a dye layer of yellow, magenta and cyan (and further black, if necessary).

According to the present invention as described above, by forming the dye layer of a sensitizer and a binder having functional groups which can react to be bonded to each other, a heat transfer sheet can be provided, which can form an image of satisfactory density with lower printing energy as compared with the prior art, and also can form an image of further higher density with the same energy as in the prior art, without causing the problems of storability and fusion to occur.

The present invention is described in more detail by referring to Examples and Comparative Examples. In the sentences, parts or % are based on weight, unless otherwise particularly noted.

EXAMPLE A AND COMPARATIVE EXAMPLE A

On the surface of a polyethylene terephthalate film with a thickness of 6 μm as the substrate applied with the heat-resistant treatment on the back opposite to the surface on which a dye layer is to be formed, an ink composition for formation of dye layer having the composition shown below was coated and dried by gravure printing to a thickness on drying of 1.0 g/$m^2$ to prepare heat transfer sheets of the present invention and Comparative Example shaped in continuous films.

| | |
|---|---|
| Kayaset Blue 714 (Nippon Kayaku, Japan, C.I. Solvent Blue 63) | 5.50 parts |
| Polyvinyl butyral resin (Ethlec BX-1, Sekisui Kagaku K.K., Japan) | 3.00 parts |
| Compound of the formula (I) | 1.00 part |
| Methyl ethyl ketone | 22.54 parts |
| Toluene | 68.18 parts |

Next, by use of a synthetic paper (Oji-Yuka, Yupo FPG 150) as the substrate film, on one surface thereof was coated a coating solution having the following composition at a ratio of 4.5 g/m$^2$ on drying, followed by drying at 100° C. for 30 minutes, to obtain image receiving materials to be used in the present invention and Comparative Example.

| | |
|---|---|
| Polyester resin (Toyobo, Japan, Vylon 200) | 11.5 parts |
| Vinyl-chloride vinyl acetate copolymer (UCC, VYHH) | 5.0 parts |
| Amino-modified silicone oil (Shinetsu Kagaku Kogyo, K.K., Japan, KF393) | 1.2 parts |
| Epoxy-modified silicone oil (Shinetsu Kagaku Kogyo, K.K., Japan, X-22-343) | 1.2 parts |
| Methyl ethyl ketone | 40.8 parts |
| Toluene | 40.8 parts |
| Cyclohexane | 20.4 parts |

Example A1

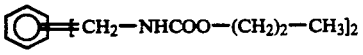

m.w. 308

Example A2

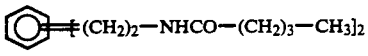

m.w. 332

Example A3

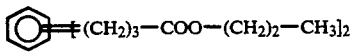

m.w. 302

Example A4

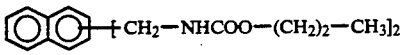

m.w. 358

Example A5
$(CH_2)=[CH_2-NHCOO-(CH_2)_2-CH_3]_2$ m.w. 246

Example A6
$(CH_2)_2=[CH_2-NHCO-(CH_2)_2-CH_3]_2$ m.w. 228

Example A7
$(CH_2)_3=[(CH_2)_2-NHCO-(CH_2)_2-CH_3]_2$ m.w. 270

Example A8

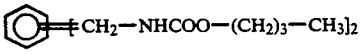

m.w. 336

Example A9
$[CH_2-NHCOO-CH_2-CH_3]_2$ m.w. 280

Example A10
$[CH_2-NHCOO-(CH_2)_5-CH_3]_2$ m.w. 392

COMPARATIVE EXAMPLE A1

Without use of the compound of the formula (I), the amount of the binder was made 4.00 parts.

COMPARATIVE EXAMPLE A2

Styrene oligomer (m.w.362) was used instead of the compound of the formula (I).

Heat transfer test

Each of the heat transfer sheet of the above-mentioned Example and Comparative Example and the image receiving material as described above were superposed as opposed to each other, and by use of a thermal head (KMT-85-6, MPD2) from the back of the heat transfer sheet, thermal head recording was performed under the conditions of a head application voltage of 12.0 V, step pattern successively reduced at every 1 msec. from applied pulse width of 16.0 msec./line, and 6 line/mm (3.3 msec./line) in the subscanning direction to give the results shown below in Table A1.

TABLE A1

| Heat transfer sheet | Relative sensitivity |
|---|---|
| Example A1 | 1.8 |
| Example A2 | 1.6 |
| Example A3 | 1.5 |
| Example A4 | 1.7 |
| Example A5 | 1.8 |
| Example A6 | 1.6 |
| Example A7 | 1.5 |
| Example A8 | 1.9 |
| Example A9 | 1.8 |
| Example A10 | 1.8 |
| Comparative Example A1 | 1.0 |
| Comparative Example A2 | 1.2 |

The relative sensitivity is determined by measuring the printed image density and comparing it relatively with the printing density of Comparative Example A1 as 1.0.

As described above, according to the present invention, the density improvement effect by 50% or more was obtained with the same printing energy by adding only a specific compound of the dye layer.

REFERENCE EXAMPLE B1

40 Parts of a copolymer of 95 mole % of methyl methacrylate and 5 mole % of hydroxyethyl methacrylate (molecular weight 120,000) were dissolved in 400 parts of a solvent mixture of equal amounts of methyl ethyl ketone and toluene, and subsequently 10 parts of the polysiloxane compound (5) as exemplified above (molecular weight 3,000) were added dropwise gradually to carry out the the reaction at 60° C. for 5 hours.

The product was found to be uniform, and no polysiloxane compound could be separated by the fractional precipitation method, indicating that it was the reaction product of the polysiloxane compound and the acrylic resin. By analysis, the amount of the polysiloxane segments was about 7.4%.

REFERENCE EXAMPLE B2

50 Parts of a polyvinyl butyral (polymerization degree 1,700, hydroxyl content 33 mole %) were dissolved in 500 parts of a solvent mixture of equal amounts of methyl ethyl ketone and toluene, and subsequently 10 parts of the polysiloxane compound (5) as exemplified above (molecular weight 3,000) were added dropwise gradually to carry out the reaction at 60° C. for 5 hours.

The product was found to be uniform, and no polysiloxane compound could be separated by the fractional precipitation method, indicating that it was the reaction product of the polysiloxane compound and the polyvinyl butyral resin. By analysis, the amount of the polysiloxane segments was about 5.2%.

REFERENCE EXAMPLE B3

70 Parts of a copolymer comprising 45 mole % of dimethyl terephthalate, 5 mole % of dimethyl monoaminoterephthalate and 50 mole % of trimethylene glycol (molecular weight 25,000) were dissolved in 700 parts of a solvent mixture of equal amounts of methyl ethyl ketone and toluene, and subsequently 10 parts of the polysiloxane compound (4) as exemplified above (molecular weight 10,000) were added dropwise gradually to carry out the reaction at 60° C. for 5 hours.

The product was found to be uniform, and no polysiloxane compound could be separated by the fractional precipitation method, indicating that it was the reaction product of the polysiloxane compound and the polyester resin. By analysis, the amount of the polysiloxane segments was about 5.4%.

REFERENCE EXAMPLE B4

80 Parts of a polyurethane resin obtained from a polyethylene adipate diol, butane diol and hexamethylene diisocyanate (molecular weight 6,000) were dissolved in 800 parts of a solvent mixture of equal amounts of methyl ethyl ketone and toluene, and subsequently 10 parts of the polysiloxane compound (6) as exemplified above (molecular weight 2,000) were added dropwise gradually to carry out the reaction at 60° C. for 5 hours.

The product was found to be uniform, and no polysiloxane compound could be separated by the fractional precipitation method, indicating that it was the reaction product of the polysiloxane compound and the polyurethane resin. By analysis, the amount of the polysiloxane segments was about 4.0%.

REFERENCE EXAMPLE B5

100 Parts of a mixture of 5 mole % of the monomer obtained by the reaction of the above-mentioned polysiloxane compound (3) (molecular weight 1,000) with methacrylic acid chloride at a molar ratio of 1:1, 45 mole % of methyl methacrylate, 40 mole % of butyl acrylate and 10 mole % of styrene and 3 parts of azobisisobutyronitrile were dissolved in 1000 parts of a solvent mixture of equal amounts of methyl ethyl ketone and toluene, and polymerization was carried out at 70° C. for 6 hours to obtain a viscous polymer solution.

The product was found to be uniform, and no polysiloxane compound could be separated by the fractional precipitation method. By analysis, the amount of the polysiloxane segments was about 6.1%.

REFERENCE EXAMPLE B6

50 Parts of a styrene-butadiene copolymer (molecular weight 150,000, butadiene 10 mole %) and 2 parts of azobisisobutyronitrile were dissolved in 500 parts of a solvent mixture of equal amounts of methyl ethyl ketone and toluene, and subsequently 10 parts of the polysiloxane compound (7) as exemplified (molecular weight 10,000) were added dropwise gradually to carry out the reaction at 60° C. for 5 hours.

The product was found to be uniform, and no polysiloxane compound could be separated by the fractional precipitation method, indicating that it was the reaction product of the polysiloxane compound and the copolymer. By analysis, the amount of the polysiloxane segments was about 6.2%.

REFERENCE EXAMPLE B7

80 Parts of a hydroxyethyl cellulose were dissolved in 800 parts of a solvent mixture of equal amounts of methyl ethyl ketone and toluene, and subsequently 10 parts of the polysiloxane compound (6) (molecular weight 2,000) were added dropwise gradually to carry out the reaction at 60° C. for 5 hours.

The product was found to be uniform, and no polysiloxane compound could be separated by the fractional precipitation method, indicating that it was the reaction product of the polysiloxane compound and the hydroxyethyl cellulose. By analysis, the amount of the polysiloxane segments was about 5.8%.

REFERENCE EXAMPLE B8

A releasable graft copolymer was obtained in the same manner as in Reference Example B1 except for using the fluorinated carbon compound (16) as exemplified above in place of the polysiloxane compound in Reference Example B1.

REFERENCE EXAMPLE B9

A releasable graft copolymer was obtained in the same manner as in Reference Example B2 except for using the fluorinated carbon compound (18) as exemplified above in place of the polysiloxane compound in Reference Example B2.

REFERENCE EXAMPLE B10

A releasable graft copolymer was obtained in the same manner as in Reference Example B5 except for using methacrylte of the fluorinated carbon compound (10) as exemplified above in place of the polysiloxane compound in Reference Example B5.

EXAMPLE B AND COMPARATIVE EXAMPLE B

On the surface of a polyethylene terephthalate film with a thickness of 6 μm as the substrate applied with the heat-resistant treatment on the back opposite to the surface on which a dye layer is to be formed, an ink composition for formation of dye layer having the composition shown below was coated and dried by gravure printing to a thickness on drying of 1.0 g/m$^2$ to prepare heat transfer sheets of the present invention and Comparative Example shaped in continuous films.

| | |
|---|---|
| Kayaset Blue 714 (Nippon Kayaku K.K., Japan, C.I. Solvent Blue 63) | 5.50 parts |
| Polyvinyl butyral resin (Ethlec BX-1, Sekisui Kagaku Kogyo K.K., Japan) | 3.00 parts |
| Sensitizer (shown below in Table B2) | 1.00 part |
| Release agent (above Reference example) | 1.00 part |
| Methyl ethyl ketone | 22.54 parts |
| Toluene | 68.18 parts |

Next, by use of a synthetic paper (Oji-Yuka, Yupo FPG 150) as the substrate film, on one surface thereof was coated a coating solution having the following composition at a ratio of 4.5 g/m$^2$ on drying, followed by drying at 100° C. for 30 minutes, to obtain image receiving materials to be used in the present invention and Comparative Example.

| | |
|---|---|
| Polyester resin (Toyobo, K.K., Japan, Vylon 200) | 11.5 parts |
| Vinylchloride-vinyl acetate copolymer (UCC, VYHH) | 5.0 parts |
| Amino-modified silicone oil (Shinetsu Kagaku Kogyo K.K., Japan, KF393) | 1.2 parts |
| Epoxy-modified silicone oil Shinetsu Kagaku Kogyo K.K., Japan, X-22-343) | 1.2 parts |
| Methyl ethyl ketone | 40.8 parts |
| Toluene | 40.8 parts |
| Cyclohexane | 20.4 parts |

Heat transfer test

Each of the heat transfer sheet of the above-mentioned Example B and Comparative Example B and the image receiving material as described above were superposed as opposed to each other, and by use of a thermal head (KMT-85-6, MPD2) from the back of the heat transfer sheet, thermal head recording was performed under the conditions of a head application voltage of 12.0 V, step pattern successively reduced at every 1 msec. from applied pulse width of 16.0 msec./-line, and 6 line/mm (33.3 msec./line) in the sub-scanning direction to give the results shown below in Table B2.

TABLE B2

| | Sensitizer | Release agent | Releasability | Relative sensitivity |
|---|---|---|---|---|
| Example | | | | |
| B1 | Polystyrene oligomer (mp = 60° C., mw = 860) | Reference Example B1 | ○ | 1.4 |
| B2 | Polyoxyethylene oligomer (mp = 50° C., mw = 900) | Reference Example B2 | ○ | 1.3 |
| B3 | Eiconsenic acid amide (mp = 79° C., mw = 310) | Reference Example B3 | ○ | 1.9 |
| B4 | Carbamic acid [1,4-phenylenebis(methylene)] bisdimethylester (mp = 95° C., mw = 252) | Reference Example B4 | ○ | 1.5 |
| B5 | 1,4-Dicyclohexylbenzene (mp = 100° C., mw = 218) | Reference Example B5 | ○ | 1.3 |
| B6 | Fluoranthene (mp = 110° C., mw = 202) | Reference Example B6 | ○ | 1.4 |
| B7 | Benzoic acid (mp = 122.5° C., mw = 122) | Reference Example B7 | ○ | 1.3 |
| B8 | o-Aminobenzophenone (mp = 110° C., mw = 197) | Reference Example B8 | ○ | 1.4 |
| B9 | Dimethyl terephthalate (mp = 142° C., mw = 194) | Reference Example B9 | ○ | 1.3 |
| B10 | Lauric acid amide (mp = 100° C., mw = 199) | Reference Example B10 | ○ | 1.4 |
| Comparative Example | | | | |
| B1 | No sensitizer (binder was made 4.0 parts) | Reference Example B1 | ○ | 1.0 |
| B2 | Polyoxyethylene oligomer (mp = 50° C., mw = 900) | NO release agent (binder was made 4.0 parts) | X | 1.3 |

The relative sensitivity was determined by measuring the printed image density and comparting it relatively with the printing density of Comparative example A1 as 1.0, and releasability was judged by peeling off the heat transfer sheet after printing:

○: easily peeled off without problem

×: peeled off with difficulty with a part of the dye layer transferred as such.

As described above, according to the present invention, the density improvement effect by 30% or more was obtained with the same printing energy by adding only a specific sensitizer and a release agent into the dye layer.

EXAMPLE C AND COMPARATIVE EXAMPLE C

On the surface of a polyethylene terephthalate film with a thickness of 6 μm as the substrate applied with the heat-resistant treatment by coating and curing of an ink for heat-resistant lubricating layer having the following composition on the back opposite to the surface on which a dye layer is to be formed, an ink composition for formation of dye layer having the composition shown below was coated and dried by gravure printing to a thickness on drying of 1.0 g/m$^2$ to prepare heat transfer sheets of the present invention and Comparative Example shaped in continuous films.

| Ink composition for heat-resistant lubricating layer | |
|---|---|
| Polyvinyl butyral (Ethlec BX-1, Sekisui Kagaku K.K., Japan) | 3.6 parts |
| Phosphoric acid ester (Plysurf A-208S, Daiichi Kogyo Seiyaku K.K., Japan) | 2.6 parts |
| Isocyanate (Barnock D-750, Dainippon Ink K.K., Japan) | 8.5 parts |
| Talc | 1.8 parts |
| Methyl ethyl ketone | 63.5 parts |
| Toluene | 20.0 parts |
| **Ink composition for formation of dye layer** | |
| Kayaset Blue 714 (Nippon Kayaku, Japan, C.I. Solvent Blue 63) | 5.50 parts |
| Binder resin (shown below in Table C2) | 3.00 parts |
| Sensitizer (shown belows in Table C2) | 1.00 part |
| Release agent | 1.00 part |
| Methyl ethyl ketone | 22.54 parts |
| Toluene | 68.18 parts |

Next, by use of a synthetic paper (Oji-Yuka, Yupo FPG 150) as the substrate film, on one surface thereof was coated a coating solution having the following composition at a ratio of 4.5 g/m$^2$ on drying, followed by drying at 80° C. for 10 minutes, to obtain heat transfer image receiving sheets to be used in the present invention and Comparative Example.

| Coating solution composition for dye receiving layer | |
|---|---|
| Polyester resin (Toyobo K.K., Japan, Vylon 600) | 4.0 parts |
| Vinylchloride-vinyl acetate copolymer (Denki Kagaku Kogyo K.K., Japan #1000A) | 6.0 parts |
| Amino-modified silicone oil (Shinetsu Kagaku Kogyo K.K., Japan, X-22-3050C) | 0.2 part |
| Epoxy-modified silicone oil | 0.2 part |

-continued

| Coating solution composition for dye receiving layer | |
|---|---|
| (Shinetsu Kagaku Kogyo K.K., Japan, X-22-3000E) | |
| Methyl ethyl ketone | 44.8 parts |
| Toluene | 44.8 parts |

Heat transfer test

Each of the heat transfer sheet of the above-mentioned Example C and Comparative Example C and the image receiving material as described above were superposed with the dye layer and the image receiving layer being opposed to each other, and by use of a thermal head (KMT-85-6, MPD2) from the back of the heat transfer sheet, thermal head recording was performed under the conditions of a head application voltage of 12.0 V, step pattern successively reduced at every 1 msec. from applied pulse width of 16.0 msec./line, and 6 line/mm (33.3 msec./line) in the sub-scanning direction to give the results shown below in Table C2.

TABLE C2

| Example, Comparative Example | Evaluation items · results | |
|---|---|---|
| Example C1 | Relative sensitivity: | 1. 3 |
| Resin: Cellulose diacetate | Storability 200 hrs: | ◎ |
| Sensitizer: Stearic acid | 500 hrs | ◎ |
| Reaction condition: Thermal reaction | Releasability: | ◎ |
| Example C2 | Relative sensitivity: | 1. 4 |
| Resin: | Storability 200 hrs: | ◎ |
| Sensitizer: Styrene oligomer | 500 hrs: | ◎ |
| Reaction condition: EB reaction | Releasability: | ◎ |
| Example C3 | Relative sensitivity: | 1. 3 |
| Resin: Epoxy-modified acryl | Storability 200 hrs: | ◎ |
| Sensitizer: Aminobenzophenone | 500 hrs: | ◎ |
| Reaction condition: Thermal reaction | Releasability: | ◎ |
| Example C4 | Relative sensitivity: | 1. 2 |
| Resin: Polyvinyl butyral | Storability 200 hrs: | ◎ |
| Sensitizer: Benzoic acid | 500 hrs: | ◎ |
| Reaction condition: Thermal reaction | Releasability: | ◎ |
| Comparative Example C1 | Relative sensitivity: | 1. 0 |
| Resin: Polyvinyl butyral | Storability 200 hrs: | ◎ |
| Sensitizer: None | 500 hrs: | ◎ |
| Reaction condition: — | Releasability: | ◎ |
| Comparative Example C2 | Relative sensitivity: | 1. 3 |
| Resin: Polyvinyl butyral | Storability 200 hrs: | ◎ |
| Sensitizer: Benzoic acid | 500 hrs: | X |
| Reaction condition: Unreacted | Releasability: | X |
| Comparative Example C3 | Relative sensitivity: | 1. 4 |
| Resin: Polyvinyl butyral | Storability 200 hrs: | ◎ |
| Sensitizer: Styrene oligomer | 500 hrs: | Δ |
| Reaction condition: Unreacted | Releasability: | X |
| Comparative Example C4 | Relative sensitivity: | 1. 4 |
| Resin: Cellulose diacetate | Storability 200 hrs: | Δ |
| Sensitizer: Stearic acid ethylenebisamide | 500 hrs: | X |
| Reaction condition: Unreacted | Releasability: | X |

Relative sensitivity: Printing image density was measured and compared relatively with the printing density of Comparative Example 1 as 1.0.

Storability: With the back of the heat transfer sheet obtained in the above Example and Comparative Example and the dye layer being superposed, a load of 20 g/cm$^2$ was applied, and after storage at 60° C., 30% RH for 200 hours and 500 hours, both were peeled off and the state of blocking of the dye layer and the back were observed.

◎: no blocking observed

Δ: blocking slightly observed

×: blocking is marked

Releasability: After the heat transfer test, the heat transfer sheet and the heat transfer image receiving sheet were peeled off and observed.

◎: no thermal fusion recognized at all

Δ: dye layer partially fused to dye receiving layer, and peeled off from heat transfer sheet ×: dye layer and dye receiving layer fused, and became unpeelable.

As described above, according to the present invention, by forming the dye layer of a sensitizer and a binder which can be bound mutually by the reaction, the density improvement effect by 30% or more could be obtained with the same printing energy, and also a heat transfer sheet having excellent releasability and storability could be obtained.

What is claimed is:

1. A heat transfer sheet comprising:

substrate film;

a dye layer provided on said substrate film, said dye layer comprising a dye, a binder and a sensitizer present in an amount of 1 to 100 parts by weight per 100 parts by weight of said binder, said sensitizer comprising a low molecular weight substance having a melting point from 50° to 150° C.;

wherein said sensitizer and said binder have functional groups substantially bonded to each other.

2. A heat transfer sheet according to claim 1, wherein said binder comprises at least one of cellulose resin, vinyl resin, acrylic resin, polyurethane resin, and polyester resin.

3. A heat transfer sheet according to claim 1, wherein said binder comprises a mold release resin comprising a graft copolymer having at least one releasable segment selected from polysiloxane segments, fluorinated carbon segments and long-chain alkyl segments graft-bonded to the main chain of the graft copolymer.

4. A heat transfer sheet according to claim 1, wherein the sensitizer is a low melting point compound having a molecular weight of 100 to 1,500.

* * * * *